US009944367B2

(12) United States Patent
Lee

(10) Patent No.: US 9,944,367 B2
(45) Date of Patent: Apr. 17, 2018

(54) PERSONAL LIFE RAFTS

(71) Applicant: LIG Sciences, Inc., Harrison City, PA (US)

(72) Inventor: Sang Beom Lee, Harrison City, PA (US)

(73) Assignee: LIG SCIENCES, INC., Harrison City, PA (US)

( * ) Notice: Subject to any disclaimer, the term of this patent is extended or adjusted under 35 U.S.C. 154(b) by 0 days.

(21) Appl. No.: 15/485,650

(22) Filed: Apr. 12, 2017

(65) Prior Publication Data

US 2017/0291669 A1 Oct. 12, 2017

Related U.S. Application Data

(60) Provisional application No. 62/321,367, filed on Apr. 12, 2016.

(51) Int. Cl.

| | |
|---|---|
| ***B63C 9/04*** | (2006.01) |
| ***B63C 9/03*** | (2006.01) |
| ***B63C 9/093*** | (2006.01) |

(52) U.S. Cl.

CPC ..... *B63C 9/04* (2013.01); *B63C 9/03* (2013.01); *B63C 9/093* (2013.01); *B63C 2009/044* (2013.01)

(58) Field of Classification Search

CPC ..... B63C 9/04; B63C 9/03

USPC ..... 441/38, 87, 88, 106, 107

See application file for complete search history.

(56) References Cited

U.S. PATENT DOCUMENTS

| | | | | |
|---|---|---|---|---|
| 5,823,839 | A * | 10/1998 | Khanamirian | A41D 13/0125 441/106 |
| 6,341,378 | B1 * | 1/2002 | Pietsch | A41D 3/06 2/85 |
| 6,859,939 | B1 * | 3/2005 | Osburn, Sr. | A41D 13/018 128/869 |
| 8,662,946 | B2 * | 3/2014 | Gadler | B63C 9/093 441/55 |

* cited by examiner

*Primary Examiner* — S. Joseph Morano
*Assistant Examiner* — Jovon Hayes
(74) *Attorney, Agent, or Firm* — Bartony & Associates, LLC

(57) ABSTRACT

A personal life raft includes a rigid compartment, a first flexible arm member in sealed engagement with a first port on a first side of the rigid compartment, a second flexible arm member in sealed engagement with a second port on a second side of the rigid compartment. Each of the first flexible arm member and the second flexible arm member are impervious to water or waterproof such that water does not pass therethrough. The rigid compartment has a body chamber therein having a volume to encompass at least an upper torso of a user of the personal life raft. The rigid compartment displaces sufficient water so that the personal life raft is buoyant while in use by the user.

21 Claims, 15 Drawing Sheets

PERSONAL LIFE RAFTS

CROSS-REFERENCE TO RELATED APPLICATIONS

This application claims benefit of U.S. Provisional Patent Application Ser. No. 62/321,367, filed Apr. 12, 2016, the disclosure of which is incorporated herein by reference.

BACKGROUND

The following information is provided to assist the reader in understanding technologies disclosed below and the environment in which such technologies may typically be used. The terms used herein are not intended to be limited to any particular narrow interpretation unless clearly stated otherwise in this document. References set forth herein may facilitate understanding of the technologies or the background thereof. The disclosure of all references cited herein are incorporated by reference.

Many different types of life rafts are available for use by those forced to abandon a vessel at sea. In many cases, life raft users become wet first before boarding the life raft. Inflatable life rafts typically use carbon dioxide for inflation. Life rafts may include a canopy or other cover to protect users from cold waves and air. Periodic maintenance is typically required to identify defects such as punctures. In the case of an inflatable raft, even small puncture may make the raft dysfunctional. Life rafts may, for example, include separate air compartments to maintain buoyancy if one or more compartments leak. Maintenance for carbon dioxide inflatable rafts is a significant issue. For example, periodic maintenance is required and new carbon dioxide canisters must be purchased after each use. Further, the carbon dioxide canisters are made of stainless steel or other metal and are thus heavy. Pressure gauges on the canisters can often provide wrong information as a result of degradation, and users must often contact a specific supplier to buy carbon dioxide canisters having the right size, the right amount of carbon dioxide, and the right pressure.

Wearable immersion suits or survival suits have also been used to protect a user from hypothermia after immersion in water resulting from, for example, abandoning a ship or from partial immersion during fishing or other water activities. Such suits are typically formed from elastomeric materials with good insulation properties (for example, polyurethanes, rubbers, neoprenes, etc.). Immersion suits may, for example, include a plurality of air pockets inflatable by mouth, by carbon dioxide canisters, or by a small handheld air pump, to provide extra buoyancy and improved insulation. Wearable immersion suits may also include a stiff, waterproof zipper that does not allow water to enter the suit. In the chest area of a wearable immersion suit, accessories may be attached that help with rescue activities (for example, a whistle, an emergency strobe, an emergency radio locater beacon, a harness, a buddy line etc.). A buddy line may, for example, be used to connect to other users equipped with wearable immersion suits so that multiple people may stay together. In one type of immersion suit, the user may wear the suit all the time. Such wearable immersion suits are sized to fit a specific user and may provide more dexterity. Another type of wearable immersion suit is oversized so that anyone can wear the suit in case of emergency. Such oversized wearable immersion suits provides more space to the user, thereby providing more freedom in the suit and more space for different user sizes, but providing for less dexterity (as a result of bulkiness) as compared to the sized wearable immersion suits.

A number of wearable immersion suits protect the wearer from hypothermia by employing better insulating materials and by providing different buoyancy methods. Attempt to improve breathing include, for example, providing a straw-like breathing apparatus in case the head of the user becomes completely submerged. Nonetheless, wearable immersion suits have many drawbacks. For example, when the user is in the water, only the user's head and a portion of the user's shoulders are exposed to the air. Because about 80% of the user's body is submersed, there is a greater chance that the user's head may be completely submerged even in relatively calm seas. In addition, to facilitate breathing immersion suits may not adequately seal the user's face. The user's face and neck may thus become wet with cold water. An exposed face and neck can quickly suffer frostbite when exposed to extremely cold water and air. Further, having a wet face and neck is uncomfortable, and may cause the user to panic, particularly in rough, and/or cold seas. It's almost impossible to keep the entire body of the user of an immersion suit totally dry. Breathing air through an apparatus such as a straw may not be easy, particularly when the user's body is under constant motion as a result of waves. Often, the user may inhale water instead of air. The gap between the user's face and the suit's face shield may be less than one inch, leaving limited room to store air when waves are high and when the occupant is completely submerged. Such risks are dramatically increased in the presence of large (for example, 15 foot to 50 foot) waves. Such large waves may repeatedly hit the user's head. In addition to causing wetness and increasing breathing difficulty, large waves may also physically injure the user's head (for example, resulting in disorientation, loss of consciousness and/or a concussion injury). Head injuries present a very dangerous scenario as the user must maintain strong mental control and good breathing ability when in the water. Additionally, accessories provided with wearable immersion suits (for example, emergency strobe, first-aid kit, radio locater beacon, food, and water) are located on the outside of the suits, which makes it more difficult for the occupant to use the accessories and more difficult to maintain waterproof conditions.

Submarine escape immersion suits (SEIS) are another type water protection system that are typically designed for a single user. A SEIS may be turned into a single-user life raft upon surfacing. A SEIS is dependent on a carbon dioxide inflation system because it must ascend to the water surface as soon as possible, before high pressure and hypothermia start to affect the wearer. Hard-shelled, deep submarine rescue vehicles (DSRV) are also available and can simplify ejection methods when abandoning a submarine. A DSRV can provide several benefits to its crew members including, for example, a supply of oxygen, precise humidity control, and communication devices. A DSRV is made of steel, and is, in essence, a small version of a submarine. Operating and pricing are thus significant issues.

SUMMARY

In one aspect, a personal life raft includes a rigid compartment, a first flexible arm member in sealed engagement with a first port on a first side of the rigid compartment, a second flexible arm member in sealed engagement with a second port on a second side of the rigid compartment. Each of the first flexible arm member and the second flexible arm member are impervious to water or waterproof such that water does not pass there through. The rigid compartment has a body chamber therein having a volume to encompass at least an upper torso of a user of the personal life raft. The rigid compartment displaces sufficient water so that the personal life raft is buoyant while in use by the user.

The personal life raft may, for example, further include a third port on a lower section of the rigid compartment and a flexible lower member in sealed connection with the third port. The flexible lower member is impervious to water or waterproof. The flexible lower member may, for example, include a lower torso portion in sealed connection with the third port and two flexible leg members extending from the lower torso portion. In a number of embodiments, each of the first flexible arm member, the second flexible arm member and the flexible lower member are adapted to be drawn inside the body chamber of the rigid compartment via the first port, the second port and the third port, respectively. In a number of embodiments, the flexible lower member includes shoulder straps in operative connection with the lower torso portion.

In a number of embodiments, the rigid compartment includes a foamed polymeric material. The foamed polymeric material may, for example, be a closed cell foamed polymeric material.

The personal life raft may further include a water port on an upper section of the rigid compartment via which water may enter the body chamber. The personal life raft may, for example, include a screen over the water port to block debris from entering the body chamber. The personal life raft may, for example, include a controller via which water flow into the body chamber from the water port is controlled. In a number of embodiments, the personal life raft further includes a raised rim extending upward from a surface of the upper section of the rigid compartment which encompasses the water port. The rim may have at least one passage therethrough, wherein the passage extends through the rim at a position above the surface of the upper section of the rigid compartment. In a number of embodiments, the rim includes a plurality of spaced passages extending through the rim, wherein each of the plurality of spaced passages is at a position above the surface of the upper section of the rigid compartment.

In a number of embodiments, the personal life raft includes an air port on an upper section of the rigid compartment via which air may enter the body chamber. The air port may, for example, be covered with a cover member in sealed engagement with the upper section of the rigid compartment through which air may pass but through which water passage is limited. In a number of embodiments, the cover member includes a super-hydrophobic textile material. The cover member may, for example, have a sloped shape such that water flows off of the cover member. The personal life raft may further include a water collector positioned within the body chamber below a cap member.

In a number of embodiments, the personal life raft further includes a light port through which an emergency light may be extended. The personal life raft may, for example, further include a light housing adapted to contain the emergency light which is extendible and retractable through the light port. The personal life raft may also include a battery compartment in operative connection with the light housing.

In a number of embodiments, the personal life raft includes an openable hatch in an upper section of the rigid compartment. In a number of embodiments, the rigid compartment further includes at least one translucent window. The translucent window may, for example, be formed from a polymeric material. The polymeric material may, for example, include a polycarbonate polymer or a polyethylene terephthalate (PET) polymer.

The personal life raft may, for example, further include at least one drag member in operative connection with the rigid compartment to create drag in air. The drag member may, for example, include a flexible wing, sail or a parachute.

In a number of embodiments, the body chamber has a volume (that is, internal volume) sufficiently large so that the entire body of the user can be housed therein. In a number of embodiments, an upper section of the rigid compartment has attached thereto an extending section which extends upward from the upper section.

In a further aspect, a method of providing life raft protection for a person on or near water includes providing personal life raft (as described above), which includes a rigid compartment, a first flexible arm member in sealed engagement with a first port on a first side of the rigid compartment, a second flexible arm member in sealed engagement with a second port on a second side of the rigid compartment, each of the first flexible arm member and the second flexible arm member being impervious to water, the rigid compartment having a body chamber therein having a volume to encompass at least an upper torso of the person, the rigid compartment displacing sufficient water so that the personal life raft is buoyant while in use by the person.

The present devices, systems, and methods, along with the attributes and attendant advantages thereof, will best be appreciated and understood in view of the following detailed description taken in conjunction with the accompanying drawings.

DETAILED DESCRIPTION

Figure 1:
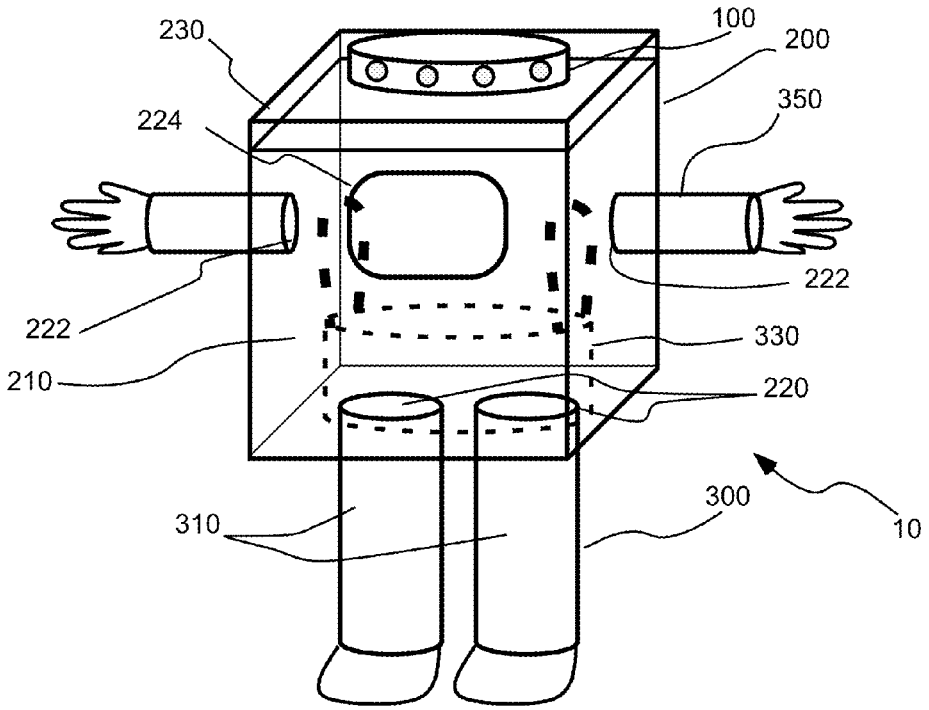
FIG. 1 illustrates a perspective view of an embodiment of a personal or wearable life raft hereof, wherein the arm members thereof and a lower member thereof are extended from a rigid compartment of the personal life raft.

It will be readily understood that the components of the embodiments, as generally described and illustrated in the figures herein, may be arranged and designed in a wide variety of different configurations in addition to the described representative embodiments. Thus, the following more detailed description of the representative embodiments, as illustrated in the figures, is not intended to limit the scope of the embodiments, as claimed, but is merely illustrative of the representative embodiments.

Reference throughout this specification to "one embodiment" or "an embodiment" (or the like) means that a particular feature, structure, or characteristic described in connection with the embodiment is included in at least one embodiment. Thus, the appearance of the phrases "in one embodiment" or "in an embodiment" or the like in various places throughout this specification are not necessarily all referring to the same embodiment.

Furthermore, described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, et cetera. In other instances, well known structures, materials, or operations are not shown or described in detail to avoid obfuscation.

As used herein and in the appended claims, the singular forms "a," "an", and "the" include plural references unless the context clearly dictates otherwise. Thus, for example, reference to "a foamed polymeric material" includes a plurality of such foamed polymeric materials and equivalents thereof known to those skilled in the art, and so forth, and reference to "the foamed polymeric material" is a reference to one or more such foamed polymeric material and equivalents thereof known to those skilled in the art, and so forth. Recitation of ranges of values herein are merely intended to serve as a shorthand method of referring individually to each separate value falling within the range. Unless otherwise indicated herein, and each separate value, as well as intermediate ranges, are incorporated into the specification as if individually recited herein. All methods described herein can be performed in any suitable order unless otherwise indicated herein or otherwise clearly contraindicated by the text.

In a number of embodiments, rafts, personal life rafts, or wearable life rafts hereof includes a rigid compartment that accommodate sat least the head and arms of a user, and a lower body member or lower member which may, for example, include a flexible wader (that is, high waterproof boots or a one-piece waterproof garment including pants with attached boots). The lower member may, for example, encompass the user's body up to the user's navel. In a number of embodiments, personal life rafts hereof include a mechanism or system for continuously exchanging air while preventing water entry. The rigid compartments of the personal life rafts hereof protect the occupant from, for example, the mechanical impact of rough waves as well as the jumping action from a ship into the ocean.

The rigid compartment includes a rigid or hard shell which includes a body chamber therein. The body chamber provides sufficient room for the upper body of the user. In a number of embodiments, at least approximately 50% of the user's body may be above the water surface while using the personal life raft. Compared to systems such as wearable immersion suits, the personal life rafts hereof reduce the chance to lose body temperature, increase buoyancy, increase the air volume in the body chamber, and reduce the chance of the user being struck by large waves. The air contained within the relatively large volume of the body chamber enables the user to breathe longer under the water when completely submerged (for example, in large waves). In embodiments including a lower member including, for example, extending boots or a wader, the user can climb into the personal life raft, walk while wearing the personal life raft, and then jump into the water. The arm members and the lower member are formed from waterproof matter (which may be insulated) and are sealed to the rigid compartment so that water does not get inside the body chamber of the rigid upper compartment.

Unlike helmets that accommodates only the head of the user, the rigid compartment of the personal life rafts hereof may, for example, accommodate at least three key upper body parts: the head, the chest and the arms. As discussed above, at least all the upper body above the user's navel are enclosed within the rigid compartment in a number of embodiments. Providing flexible arm members and a flexible lower member for the user's legs in operative connection with the rigid compartment provides the user with greater dexterity, while the rigid compartment (which is significantly more rigid than the flexible arm and leg members) protects the user's head and upper torso from the physical shocks of high waves, thereby improving the user's chances for survival.

In a number of embodiments, the rigid compartment includes an upper section which may be openable as a sealable access lid. Through the access lid, the user may get into or don the personal life raft while on a vessel, close and lock the access lid, and then jump into the water. In this manner, the user may never contact the water to become wet. An embodiment wherein the legs of the user extend below the bottom section, portion of plate of the rigid compartment, the center of gravity of the personal life raft will be low (for example, almost at the bottom of the rigid compartment). Thus, the risk of capsizing is reduced or minimized.

The arm members of the rigid compartment may include or be in the form of flexible, long gloves so that the user may do at least some minimum hand work while the user is in the personal life raft. Because both the arm members and lower member are made of flexible materials, they may be withdrawn or retracted within the inside or body chamber of the rigid compartment when the personal life raft is not in use.

The rigid compartment is a hard-shelled compartment, but the materials for the rigid compartment need not be extremely rigid materials. The rigid compartment may, for example, be fabricated from polymeric materials such as waterproof, closed-cell, foam materials (for example, polyethylene foams, polyurethane foams, and polystyrene foams. Such materials and other materials may, for example, provide for the wall thickness of the rigid chamber in the range of, for example, approximately 1 inch to 3 inches. The rigid compartment should be sufficiently rigid to protect the occupant from 30 foot to 50 foot waves. Moreover, the rigid compartment may be somewhat flexible to absorb shocks from, for example, the user's action of jumping into the ocean. The material of the rigid compartment (for example, a closed-cell polymer foam material) may itself be less dense than water to provide buoyancy even if there is a leak in the rigid compartment. The material(s) for the rigid compartment may, for example, be suitable to absorb shocks/forces experienced during use, but be resistant to tears and other damage under such shocks/forces. In a number of embodiment, the young's modulus of the material for the rigid compartment is in the range of 0.8 to 4 GPa.

FIG. 1 illustrates a personal or wearable life raft 10 including a box or cuboid rigid compartment 200 which includes a body chamber therein. Although rigid compartment 200 is illustrated as a cube, cuboid, box or rectangular box (referred to herein collectively as a cuboid) it can take other shapes (for example, generally cylindrical). Personal life raft 10 further includes a lower member or lower body member 300 including a wader or extending boots 310.In the case of a wader, boots 310 are attached to a lower body portion 330 which is sealingly attached to the lower surface of rigid compartment 200. (as described further below). Alternatively, extending boots 310 may be sealingly attached to rigid compartment 200. In such embodiment, the user's legs are preferably at least as long or longer than the length of boots 310.

Figure 2:
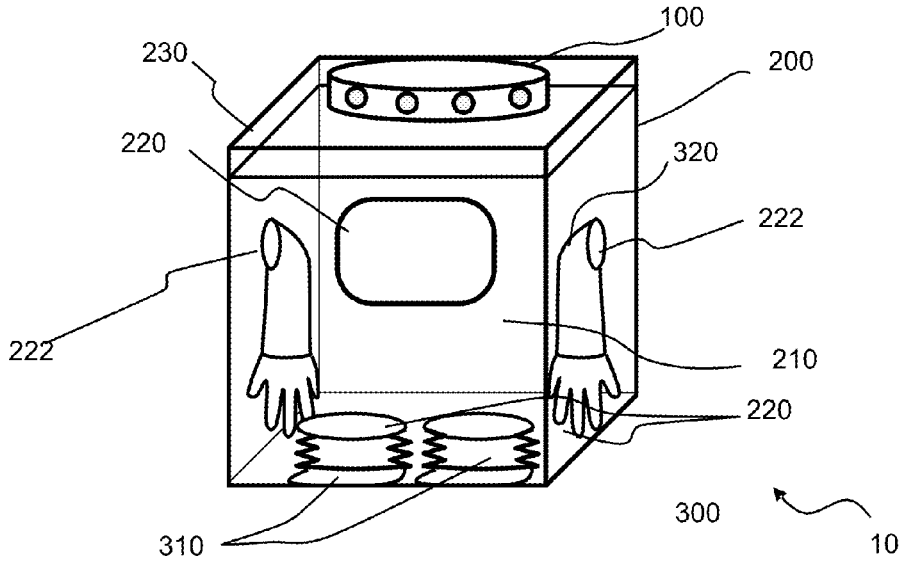
FIG. 2 illustrates the personal life raft of FIG. 1 wherein the arm members and the lower member are withdrawn into and folded within a body chamber within the rigid compartment.
Figure 3:
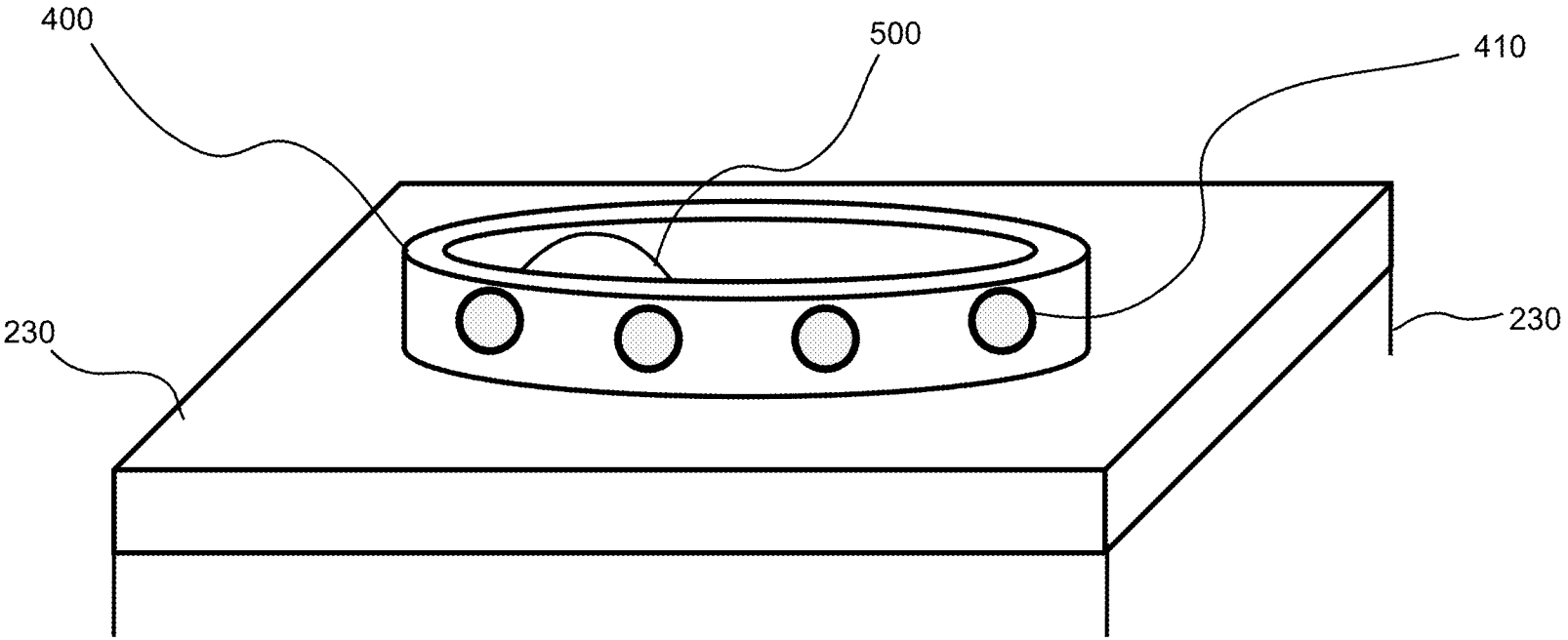
FIG. 3 illustrates a perspective view of an upper section of the rigid compartment of the personal life raft of FIG. 1 illustrating an annular flange, rim or ring which extends upward from the upper section and encompasses, for example, a water port to assist in collecting rain.
Figure 4:
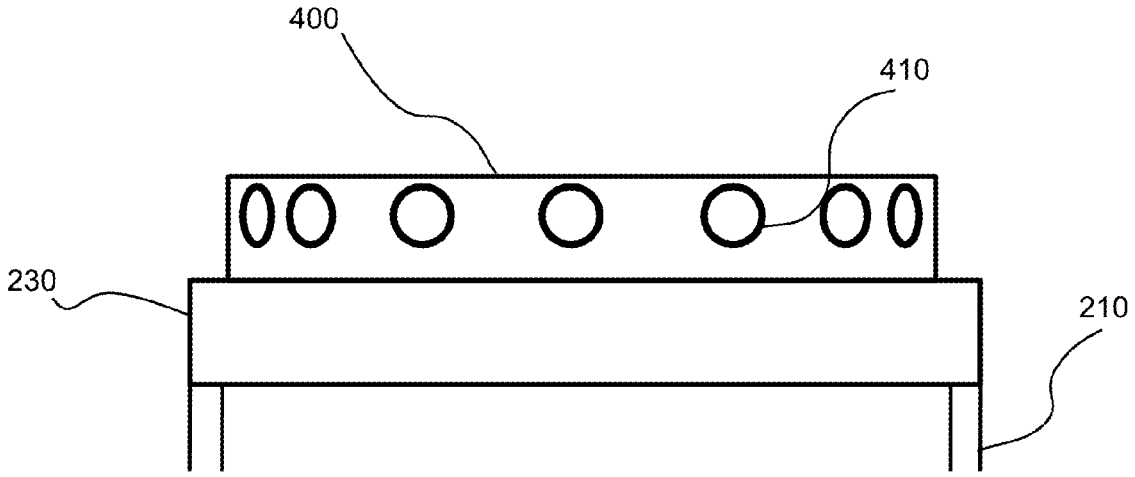
FIG. 4 illustrates a side view of the upper section of the rigid compartment, showing a plurality of spaced passages extending through the rim which are positioned higher than or above the top surface upper section of the personal life raft.

Personal life raft 10, including a upper, rigid compartment 200 and lower member 300 has a center of gravity during use that is almost at the bottom of rigid chamber 200, which minimizes or eliminates the risk of capsizing personal life raft 10. Minimizing or eliminating capsizing is an important goal in any life raft. FIG. 2 shows how both lower member 300 and flexible arm members 350 (including, for example, extending gloves) may be retracted into a body chamber 210 of rigid compartment 200 when the raft is not in use via ports 220 and 222, respectively, of rigid compartment 200 to which lower member 300 and arm members 350 are connected in a water sealed or waterproof manner. Retracting the lower member 300 and the arm members 350 into body chamber 210 facilitates storage of personal life raft 10, which may be stacked with other like personal life rafts 10.

Figure 13:
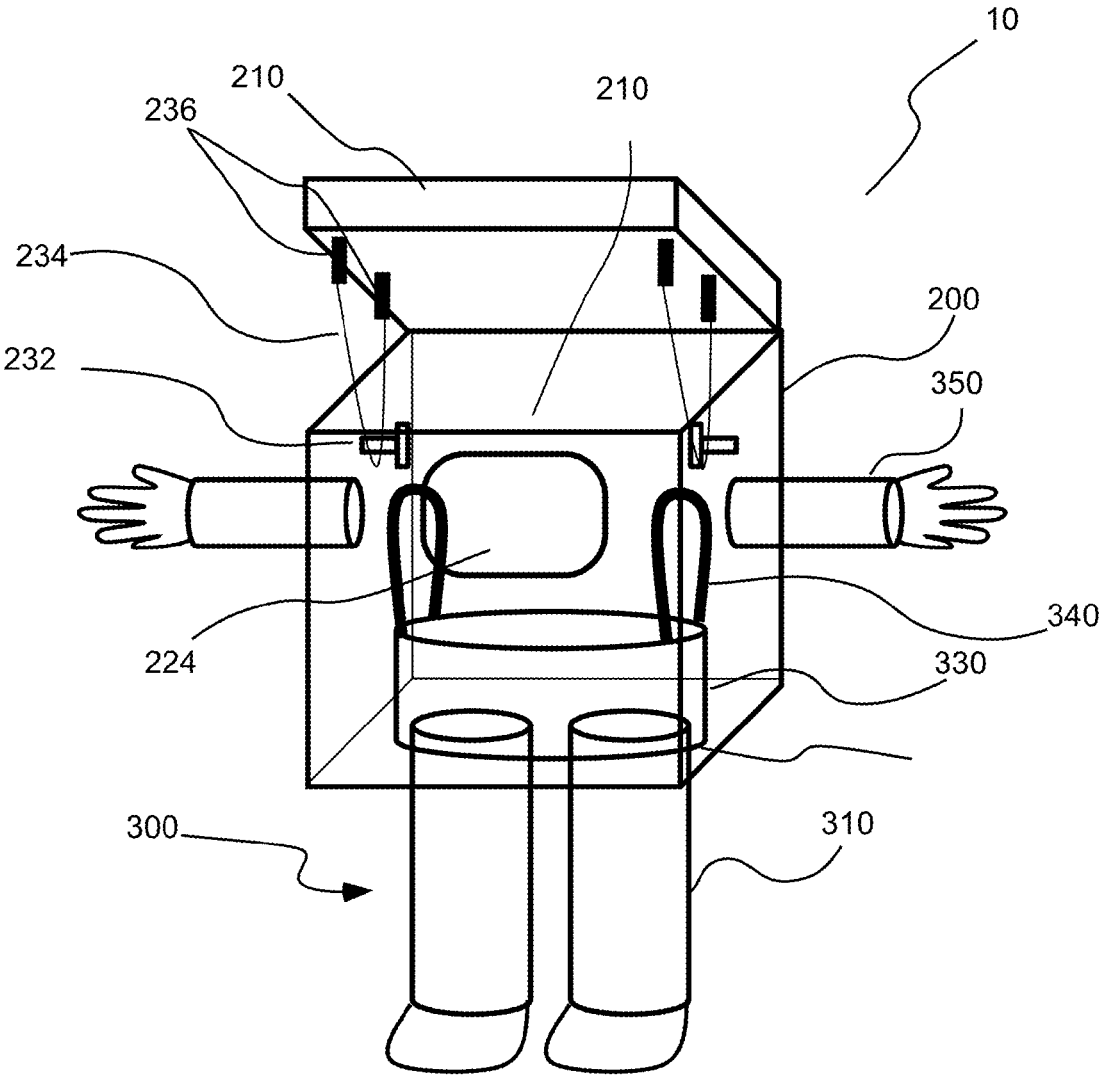
FIG. 13 illustrates the personal life raft of FIG. 12 showing a locking system for a lid of the rigid compartment.
Figure 14B:
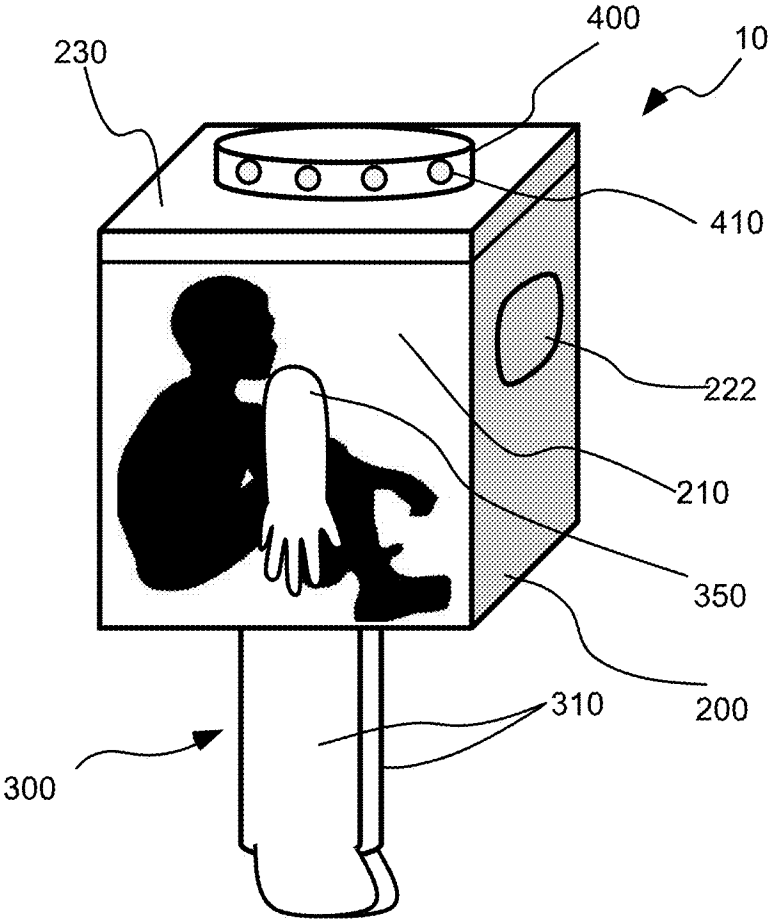
FIG. 14B illustrates a perspective, side view of the personal life raft of FIG. 14A with a user sitting within the rigid compartment of the personal life raft.
Figure 14A:
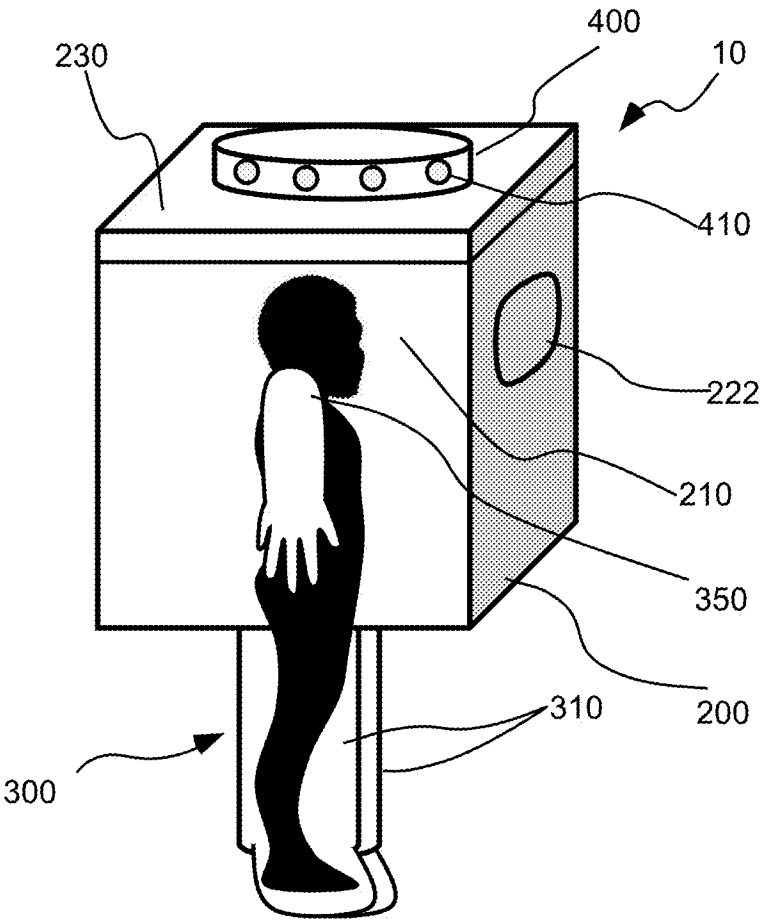
FIG. 14A illustrates a perspective, side view of an embodiment of a personal life raft hereof with a user standing in the personal life raft.

FIGS. 2, 13 and 14A, for example, show the manner in which a user can climb into the personal life raft 10 via an upper section 230 of rigid compartment 200, which may, for example, be hinged as illustrated in FIG. 13 to be openable in the manner of a lid or a hatch. As illustrated in FIG. 14A, the user may climb into body chamber 210, place the users legs within extending boots 310 of lower member 300, close and lock/seal upper section 230, and jump into the water. Personal life raft 10 does not take on water when the user enters body chamber 210 and enters the water. The user does not get wet because the user dons personal life raft 10 before entering the water. Therefore, there is little or no chance that the user is exposed to or touches water. Maintaining the user in a dry state greatly reduces the risk of hypothermia. The rigid compartment 200 may, for example, include a viewing window 230 permitting the user to see outside while, for example walking on the vessel deck, jumping from the vessel into the water, and swimming/floating in the water.

Personal life raft 10 may include a number of features and/or accessories to increase the user's chances for survival at sea. For example, having a source of drinkable water may be one of the most important needs for surviving longer in a raft in water. As, for example, illustrated in FIGS. 3 through 7, a rim or flange 400 extending upward from upper section 230 which may operate as a rain collector to collect rain as a source of drinkable water. Although extending rim 400 is illustrated as circular, annular or ring-shaped, it can have many other shapes (for example, oval, square or rectangular). In the illustrated embodiment, extending rim 400 includes a plurality of passages 410 extending laterally therethrough. Most sea water falling within the perimeter of extending rim 400 may pass out through these passages. Passages 410, may, for example, be positioned on extending rim 400 above or higher than the top surface upper section 230 of the rigid compartment 200. During a rain shower, fresh water from rain is collected within extending rim 400 up to the height of passages 410.

Figure 7:
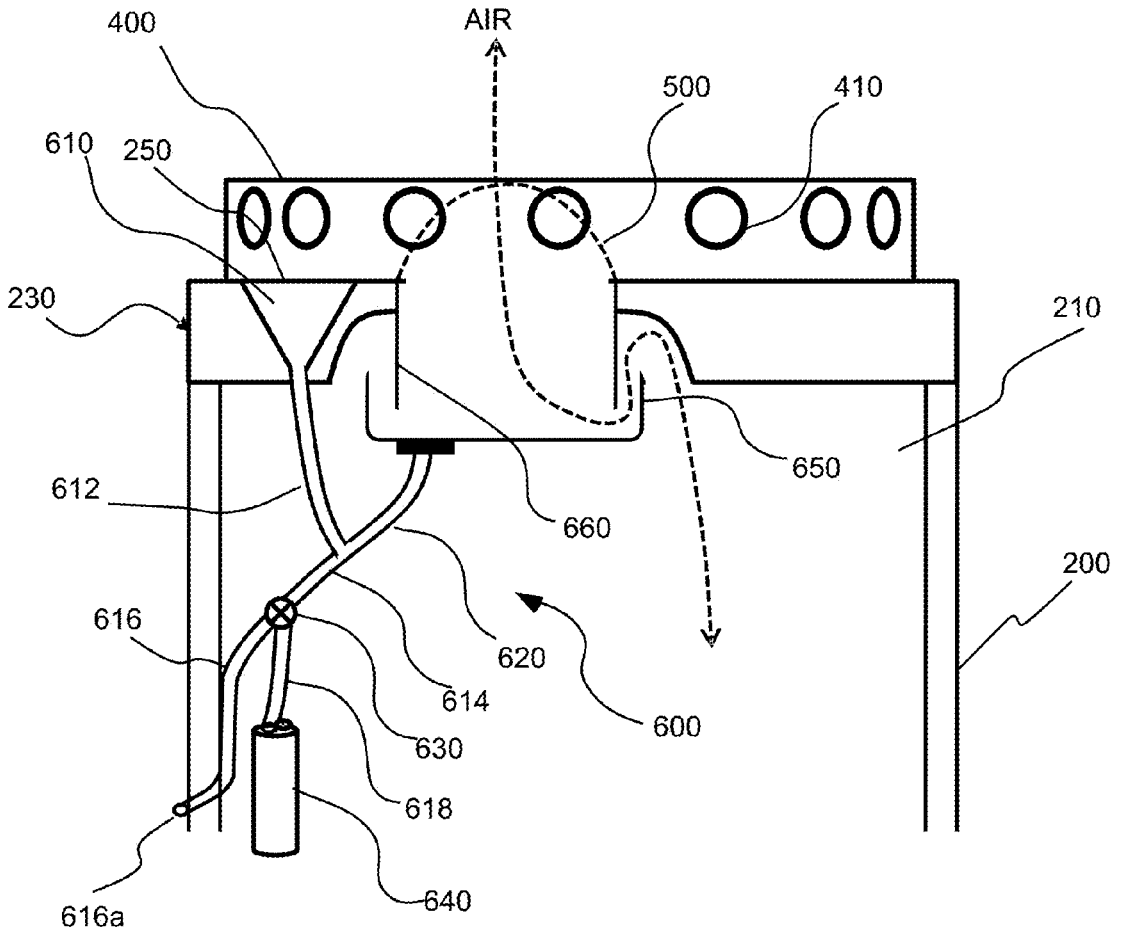
FIG. 7 illustrates a side, cutaway view of an upper portion of the rigid compartment showing how air can move in and out through the breathing dome and a drain system which may be used to separate fresh rain from seawater to generate drinkable water.

Collected water can pass via a drain system in operative connection with a water port 250 formed in upper section 230 of rigid compartment 200. Collected water in a number of embodiments may also pass through a protective breathing dome 500 formed in upper section 230. The protective breathing dome 500, is described further below. Collected water passes through water port 250 into a water collection system 600. FIG. 7 illustrates details of breathing dome 500 and water collection system 600. In the illustrated embodiment, the collection system 600 may collect both rain water and sea water. Sea water may, for example, be collected in collection system 600 when there are large waves. As described above, most sea water may exit the interior area of extending rim 400 through the passages 410.The seawater remaining within the perimeter of extending rim 400 may flow through water port 250 into a funnel 610 and, thereafter, into tubing sections 612 and 614. Seawater may exit collection system 600 via tubing outlet 616*a* of a tubing section 616 which passes through rigid chamber 200. In this manner, seawater can be drained from the collection area within extending rim 400 so that the collection area is emptied and ready to collect rain. In a similar manner, during a rain event, rain is collected within the collection area of extending rim 400, and passes through funnel 610 into tubing sections 612 and 614. In the illustrated embodiment, a flow controller such as a three-way bypass valve 630 is in fluid connection with tubing section 614. Tubing section 616 and a first end of tubing section 618 are also in fluid connection with valve 630. As described above, tubing section 616 passes through rigid compartment 200 to allow water (for example, seawater) to drain from collection system 600. A second end of tubing section 618 is in fluid connection with a container 640 for collection of rain water. Via appropriate control of valve 630, water can be caused to flow from tubing section 614 to either tubing section 616 (to discharge from collection system 600) or to tubing section 618 for collection in container 640. In the above manner, the user of personal life raft 10 may separate rain as a drinkable water source from seawater, which is not drinkable. In addition to water container 640, there may be compartments for food, extra water, and other emergency supplies inside body chamber 210. Such items may not be stored inside conventional wearable immersion suits, which have little space within the suit.

As described above, a protective breathing dome 500 is also positioned within the collection area within the perimeter of extending rim 400. The height of the rain collector may, for example, be as least the same height or higher than the top of protective breathing dome 500 so that extending rim 400 can serve as a barrier to shield protective breathing dome 500 from contact with, for example, debris and rough waves. Protective breathing dome 500 may, for example, be made of non-woven or half-woven textiles that are coated with hydrophobic or super-hydrophobic (also referred to as ultra-hydrophobic) materials. Ultra-hydrophobic or super-hydrophobic surfaces are highly hydrophobic. In that regard, such surfaces are extremely difficult to wet. In general, contact angles of a water droplet on such surfaces exceeds 150°. Contact angles of a water droplet on hydrophobic surfaces are typically greater than or equal to 110°. Further, the roll-off angle/contact angle hysteresis is less than 10°. The shape of the protective breathing dome 500 may, for example, be sloped or arched so that water droplets may roll down easily. Thus, rainwater and seawater are substantially prevented or prevented from passing through protective breathing dome 500. However, air from outside of personal life raft 10 can readily pass through protective breathing dome 500. However, seawater, as a result of the force associated with very strong waves may sometimes pass through protective breathing dome 500. In addition, when personal life raft 10 is completely submerged in water, seawater may also pass through even a super-hydrophobic, protective breathing dome 500. For such eventualities, a seawater collector 650 that collects sea water that passes through the protective breathing dome 500 may be provided within body chamber 210. Collected seawater flows through tubing section 620, which is in fluid connection with seawater collector 650, to tubing section 614, valve 630, and then through tubing section 616 to discharged from personal life raft 10. An extender 650 (see FIG. 7), which extends to a height at least equal to the height of the bottom of passages 660 may, for example, be provided to further prevent rain water collected within the collection area defined by extending rim 650 from entering body chamber 200. Ambient air may travel in and out of body chamber 210 freely to provide oxygen to the user, and the user may obtain drinkable water from rain, while both seawater and rain water cannot wet the user.

Figure 8:
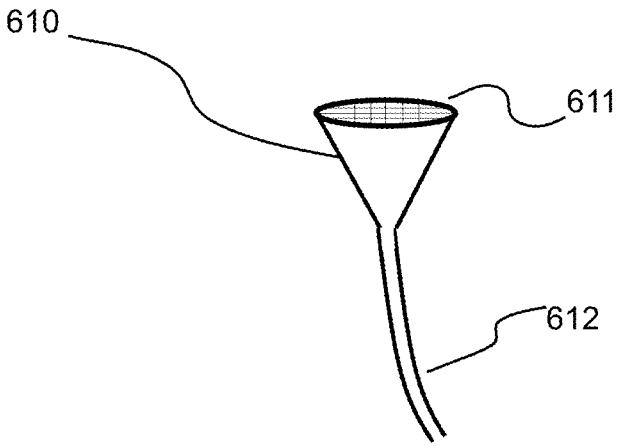
FIG. 8 illustrates a perspective view of another embodiment of the funnel used in rain collection.

FIG. 8 illustrates an enlarged view of funnel 610 of collection system 600. Funnel 610 may, for example, include a mesh covering 611 so that other solid materials (for example, debris and sand) from seawater may not enter funnel 610 and tubing section 612, which may clog or contaminate collection system 600. Each cell size of mesh 611 may be smaller than the inner diameter of the tubing section 612. Materials for the mesh include, but are not limited to, stainless and plastics.

Figure 5:
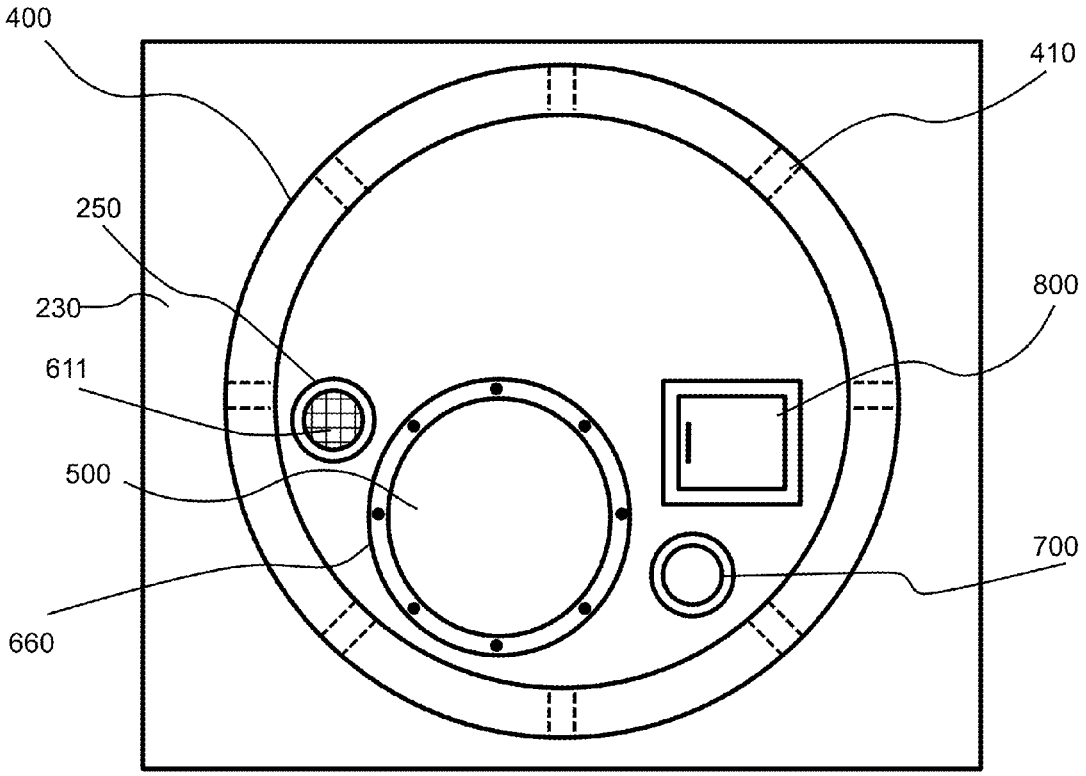
FIG. 5 illustrates a top view of the upper section of the rigid compartment, showing a breathing port covered by a hydrophobic dome through which air can pass but water passage is limited or prevented, a water port, light port, and a small hatch, each of which is encompassed by or positioned within the upward extending rim.
Figure 6:
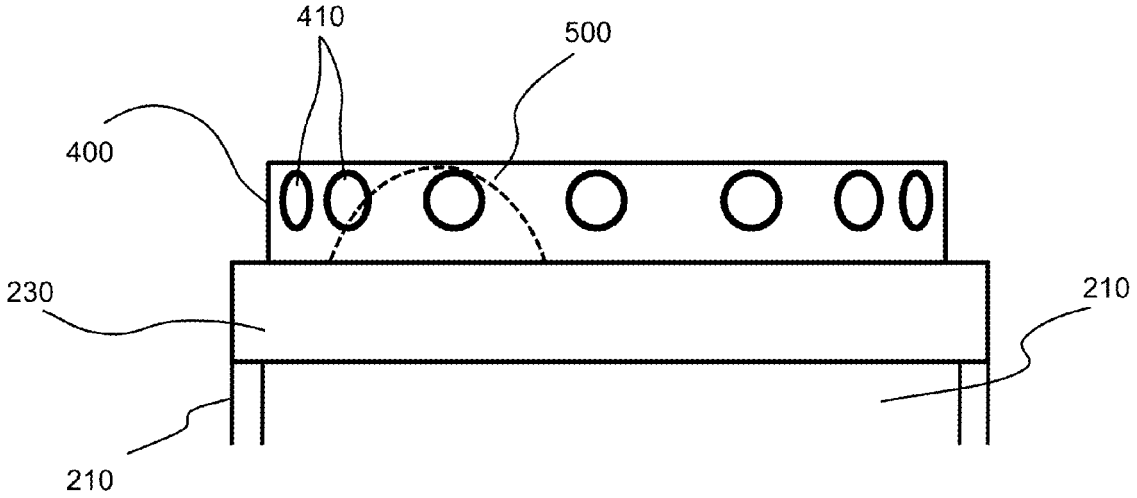
FIG. 6 illustrates another side view of the upper section of the rigid compartment, showing that the top of the dome covering the water port may be at the same height or lower in height than the extending rim, so that the extending rim may protect the dome from mechanical damage in addition to assisting in collecting rain water.

FIG. 5 illustrates a top view of upper section 230 showing that, in addition to a water port 250 and an air port 260, extending rim 400 may encompass other items such as a lighting port 270 and a hatch port 280. All such items may for example, be placed in fluid connection with collection system 600 so that rain or seawater can flow into and through body chamber 210 via collection system 600.

Figures 9A, 9B:
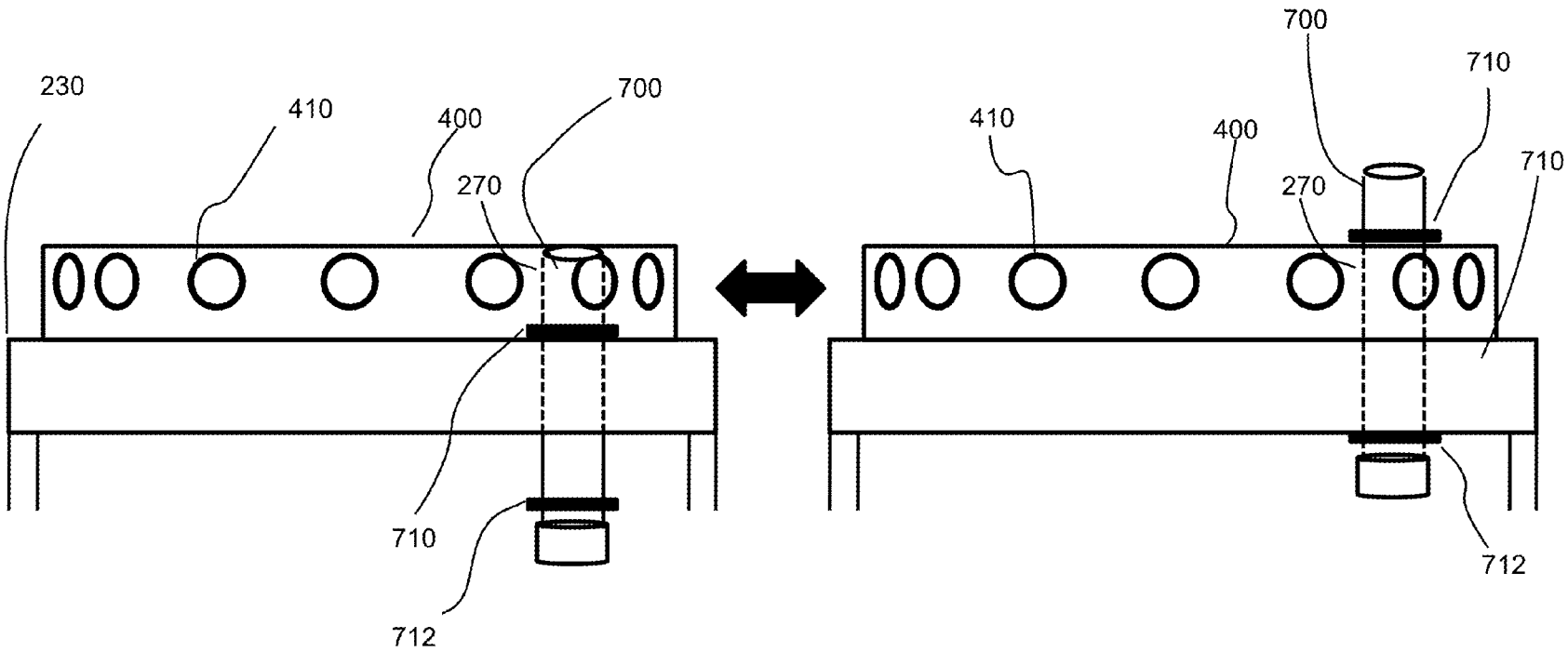
FIG. 9A illustrates a side view of the upper section of the rigid compartment wherein a light housing is in a retracted state.
FIG. 9B illustrates another side view of the upper section of the rigid compartment wherein a light housing is in an extended state.
Figure 10B:
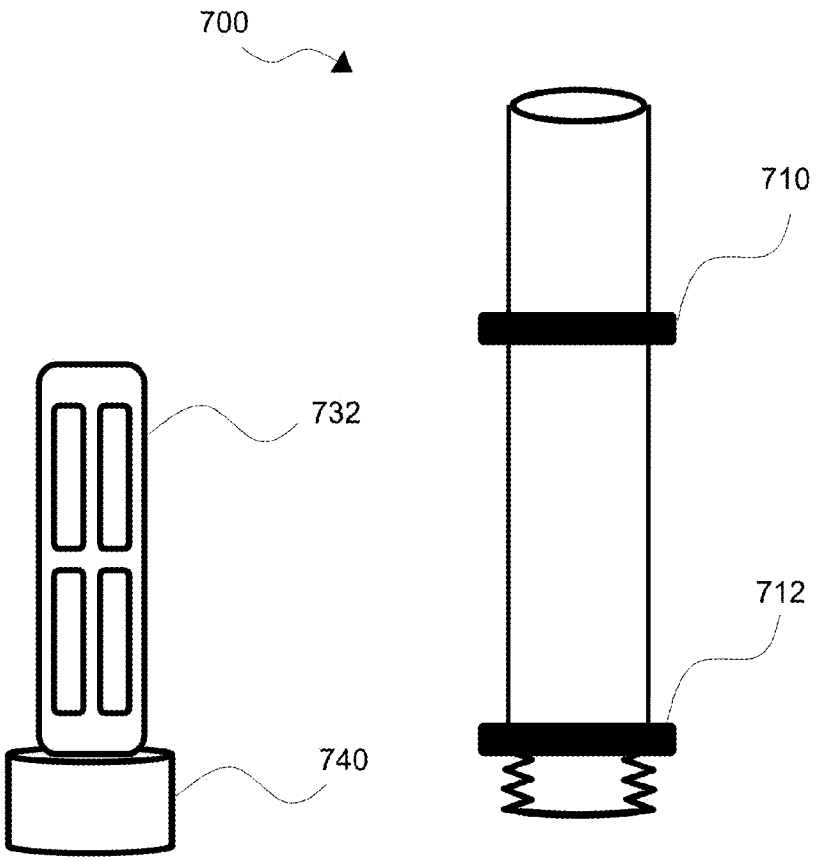
FIG. 10B illustrates a side view of the light housing of FIG. 10A with the battery holder and integral bottom enclosure removed from the light housing.
Figure 10A:
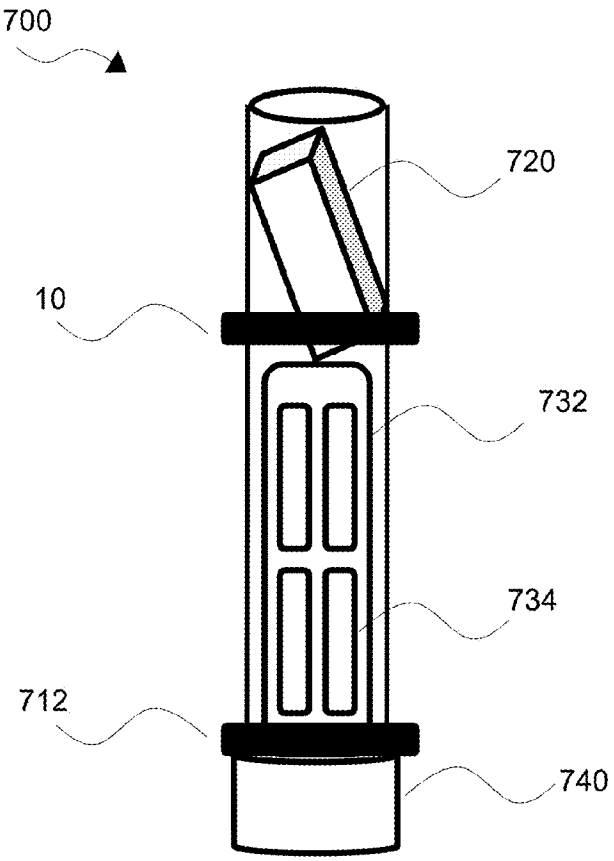
FIG. 10A illustrates a side view of another embodiment of a light housing that can, for example, accommodate an emergency strobe and a holder for extra batteries.

FIGS. 9A and 9B illustrate side views of the telescopic light housing 700 that can be extendible and retractable through lighting port 270. Light housing 700 may be placed in a retracted or downward state when personal life raft 10 is not in use. In the illustrated embodiment, light housing 700 includes two abutment members or rings 710 and 712, which abut in outer surface and inner surface, respectively, of upper section 230 to prevent light housing 700 from travelling up or down too much. A sealant such as a silicone grease may be placed between the light housing and the surface of lighting port 270 so that water does not enter body chamber 210 through a potential gap between the light housing and the surface of lighting port 270 even though the material for upper section 230 may include a foam with some elastic properties that creates a tight hold around light housing 700. An enlarged side view of light housing 700 is illustrated in FIGS. 10A and 10B. As illustrated in FIGS. 10A and 10B, light housing may accommodate a light such as an emergency strobe 720, which is powered by batteries Light housing 700 may also enclose extra batteries 734. Battery holder 732 may, for example, be attached to the light housing bottom enclosure or lid 740 as shown in FIG. 10B. Light housing 700 may be waterproof to protect items inside light housing from moisture and water. Light housing 700 may, for example, be made from transparent plastics, such as polycarbonate or polyethylene terephthalate (PET), and it may be pushed by the user above extending rim 400 so that emergency strobe light 720 may be located easily by rescuers.

Figure 11:
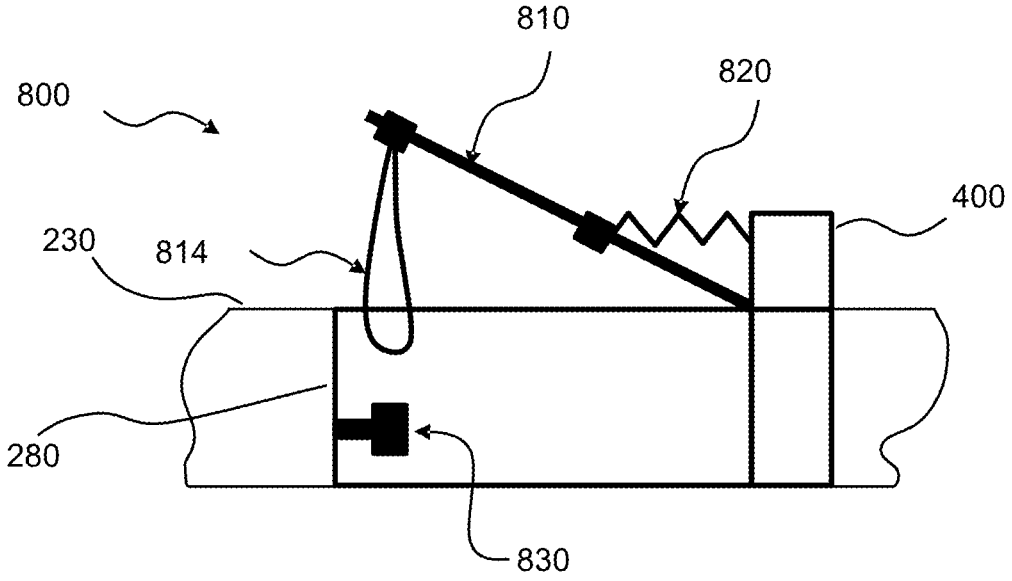
FIG. 11 illustrates a side view of a relatively small hatch/port to, for example, provide extra breathing air, as well as an opening that may, for example, be used for shooting flares, fishing activities etc.
Figure 12:
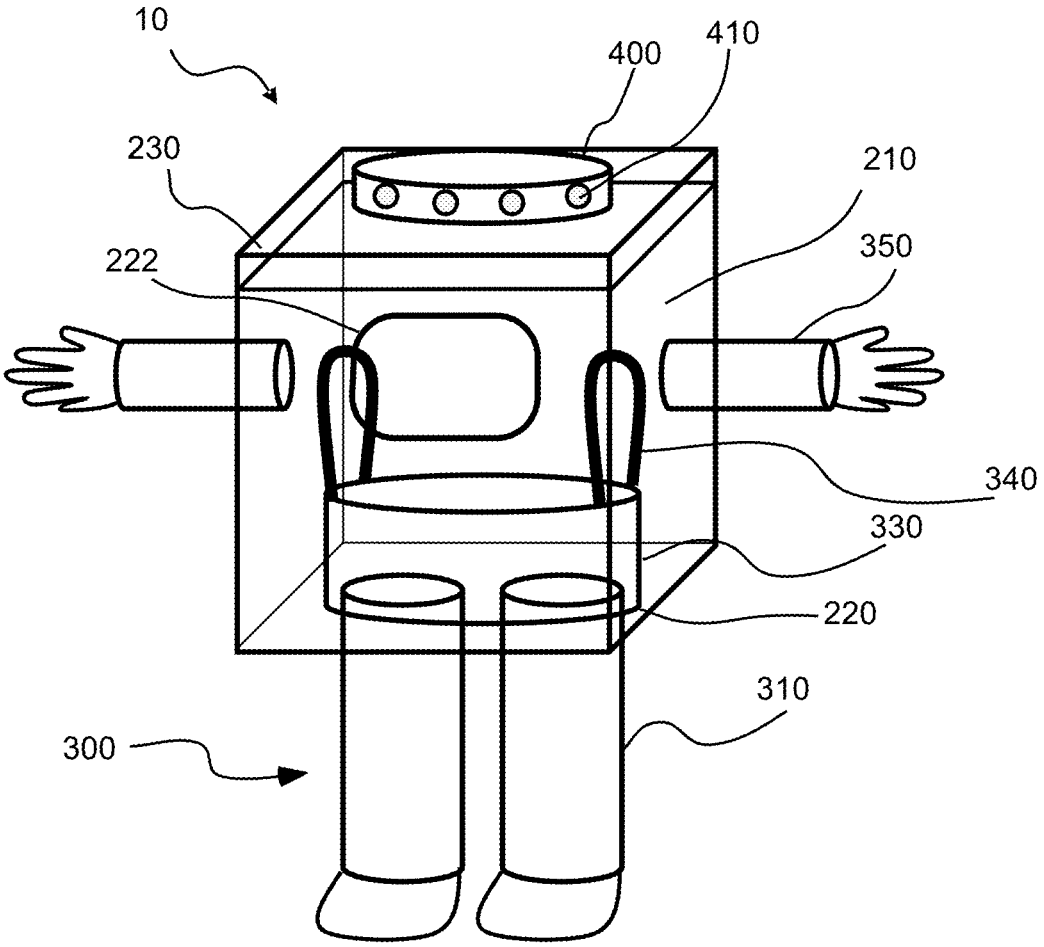
FIG. 12 illustrates a transparent, perspective view of an embodiment of a personal life raft hereof wherein a lower member includes a flexible wader having bib-style suspenders that accommodates the lower body of the user.

FIG. 11 illustrates a side view of the small hatch 800 positioned within a hatch port 280 in upper section 230 and within the perimeter of extending rim 400. Hatch 800 may, for example, include a transparent or translucent lid 810. In the illustrated embodiment, a spring 820 is connected to the inner surface or wall of extending rim 400 at one end and to hatch lid 810 at the other end to keep hatch lid 810 open, unless the user wants to close lid 810 by, for example, pulling a loop such as an elastic band 814 and hooking it onto a securement 830 when, for example, there are large waves. Keeping hatch lid 810 open assists in providing enough air to the user and removes moisture and sweat from body chamber 210 of personal life raft 10. In a number of embodiments, the user may perform activities through small hatch 800 such as actuating/shooting emergency flares and fishing.

FIGS. 12 through 14B illustrate how a user can don/wear personal life raft 10. As described above, the user first climbs inside personal life raft 210 after opening upper section 230 as illustrated in FIG. 13. After entering into body chamber 210, the user may sit and place the user's lower torso within lower torso portion 330 of lower member 300 and the user's legs within boots 310 of lower member 300. The user then places suspenders 340, attached to lower torso portion 330 of lower member 300 on the shoulders of the user. After these actions, the user closes and secures upper section 230, stands up, and jumps in the water. Lower torso portion 330 of lower member 300 joins the suspenders 340 and extending boots 310. Lower torso portion 330 is attached to port 220 of rigid compartment 200 via a waterproof seal. Direct attachment between the lower torso portion 330 and the upper body chamber 210 assists in freeing the user's lower body to walk, jump and swim. Lower member 300 and arm members 350 may, for example, be made from a thick rubber, neoprene, or flexible PVC for good insulation to avoid hypothermia.

A locking or sealing system for upper section 230 is illustrated in FIG. 13. The locking system prevents water from coming in from the outside through the connection of upper section 230 and the remainder of rigid compartment 200. In the illustrated embodiment, there are two hooks 232 inside body chamber 210. Each hook 232 may hold four points from upper section 210 through chords such as elastic cords 234 attached to upper section 210 via connectors 236. In this way, the occupant can close upper section 230 quickly in case of an emergency situation.

To stay longer in personal life raft 200, the entire body of the user may be drawn inside body chamber 210, as illustrated in FIGS. 14A and 14B. Body chamber 210 may be of suitable volume to enable the user to pull their lower torso and legs inside body chamber 210 in a sitting position as illustrated in FIG. 14B. The size of body chamber 210 may be varied for use by users of any size. In a number of representative embodiments, the inner dimensions of body chamber 210 were in the range of from 16 in.(W)×16 in.(L)×22 in. (H) to 25 in.(W)×33 in.(L)×33 in.(H). In a number of such representative embodiments, the wall thickness of a closed-cell, polymeric foam rigid compartment 200 ranged between approximately 0.5 in. to 4 in. The weight of the personal life raft may, for example, be in the range of approximately 15 lbs. to 40 lbs. Even when the user is using lower member 300 hereof, 50% or more of the user's body, including the user's head, are out of the water and within body chamber 210, thereby substantially decreasing the risk of hypothermia as compared to, for example, wearable immersion suits. Similar to wearable immersion suits, arm member 350 and lower member 300 may be provided with insulating materials as known in the insulating arts.

Figure 15B:
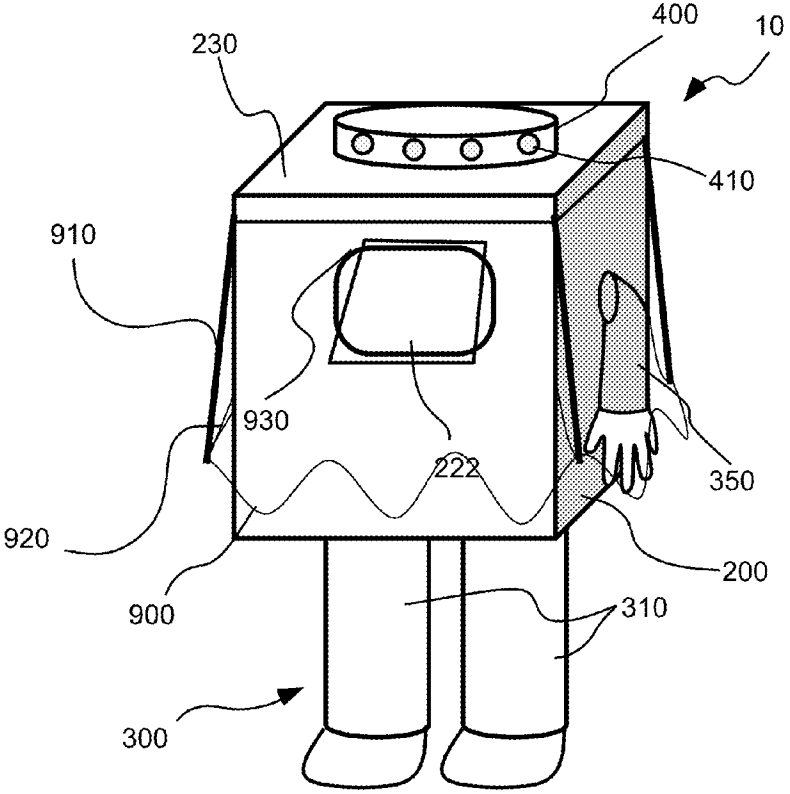
FIG. 15B illustrates a perspective view of the personal life raft of FIG. 15A with the parachute or wing in a folded state.
Figure 15A:
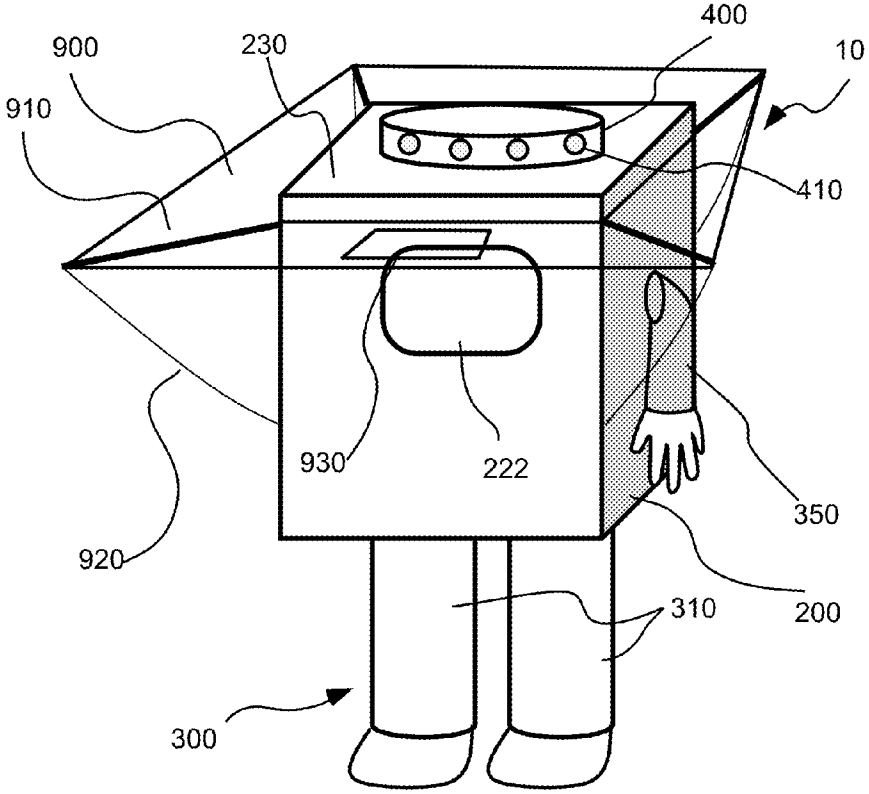
FIG. 15A illustrates a perspective view of a personal life raft hereof including an opened parachute or wing to create air drag when, for example, jumping from a vessel such as a battleship, an aircraft carrier, an oil rig, a cruise ship, or a cargo ship.

FIGS. 15A and 15B illustrate that personal life raft 10 may include a parachute or wing(s) so that personal life raft 10 may be used for larger ships, for example, battleships, aircraft carrier, cargo ships, and oil rigs, in which the deck sits high off the water. FIG. 15A shows a deployed parachute 900, and FIG. 15B shows a folded, undeployed parachute 900. Parachute 900 may be used to retard the falling speed of the user when jumping from larger ships to minimize the shock or force experienced by the user upon entry into the water. Parachute 900 is, for example, nylon fabric. One or more poles or rigid members 910 may be used to maintain the shape of deployed parachute 900. A string or chord 920 may be used to support and stabilize poles 910. Parachute 900 may be transparent or include a viewing window 930 made, for example, of clear flexible plastic material. Window 930 and window 222 may align when parachute 900 is undeployed to allow the user to see through while, for example, walking on the ship deck, and jumping in the water.

Figure 16:
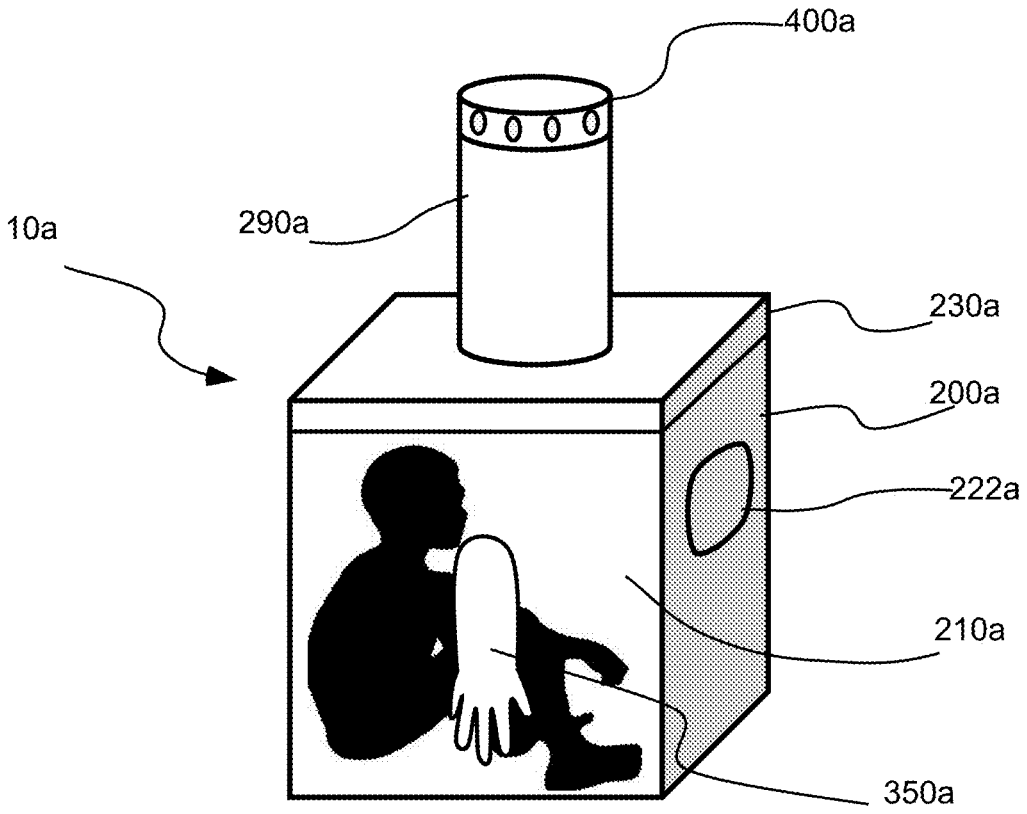
FIG. 16 illustrates a perspective, side view of an embodiment of a personal life raft which may not include a flexible lower member or lower body member, but which includes an extending section attached to an upper section of the rigid compartment to, for example, assist in stabilizing buoyancy or preventing capsizing.

In another embodiment, a personal life raft 10 as illustrated in FIG. 16 does not include a lower member or lower body member as described. In many ways, personal life raft 10*a* is similar to personal life raft 10, and components of personal life raft 10*a* are numbered similarly to corresponding components of life raft 10 with the addition of the designation "a" to the reference number. Because personal life raft 10*a* does not include a lower member, the center of gravity thereof moves toward the center of rigid compartment 210*a* (as compared to personal life raft 10). A higher center of gravity may increase the risk of capsizing. To lower the center of gravity and decrease the risk of capsizing, an extending chamber or neck 290*a* is included between an extending rim 400*a* and upper section or lid 230*a*. In this manner, personal life raft may stay upright at all times in the water similar to a floating bottle with a long narrow neck. In a number of embodiments, diameter of the extending member or neck 290*a* is smaller than a human's head or at least smaller than a human's shoulders so that, for example, waves may not force the user to move inside extending member or neck 290*a* and change the center of gravity of personal life raft 10*a*.

In any of the embodiment hereof, the personal life rafts may be stored in multiple, readily connectible sections, panels or pieces. For example, in a cuboidal embodiment as described herein, each of the six sides of the rigid compartment may be stored in a disconnected state and readily and quickly assembled for use. Referring to the example of personal life raft 10*a*, each side or panel of the cuboidal rigid compartment 210*a* thereof may be stored in a disconnected state. A section of the rigid compartment having elements extending therefrom (for example, upper section or lid 230*a* with extending member or neck 290*a* extending therefrom) may be stored as an assembly, or the extending section or element may be stored in a disassembled state and readily and quickly assembled before use. Storing the personal life rafts hereof in multiple sections may, for example, reduce the required storage space.

The personal life rafts hereof have numerous applications. The personal life rafts hereof may, for example, be used as a survival life raft for fishing boats to protect the user from hypothermia. In addition, the personal life rafts hereof may be used in jumping from, for example, high vessel decks such as found on aircraft carriers, other military ships, cruise ships and commercial cargo ships to provide improved safety to crew and passengers. The personal life rafts hereof may also be used for protection in flooding as occurs, for example, in connection with tsunami.

The foregoing description and accompanying drawings set forth a number of representative embodiments at the present time. Various modifications, additions and alternative designs will, of course, become apparent to those skilled in the art in light of the foregoing teachings without departing from the scope hereof, which is indicated by the following claims rather than by the foregoing description. All changes and variations that fall within the meaning and range of the equivalency of the claims are to be embraced within their scope.

What is claimed is:

1. A personal life raft, comprising: a rigid compartment, a first flexible arm member in sealed engagement with a first port on a first side of the rigid compartment, a second flexible arm member in sealed engagement with a second port on a second side of the rigid compartment, each of the first flexible arm member and the second flexible arm member being impervious to water, the rigid compartment having a body chamber therein having a volume to encompass at least an upper torso of a user of the personal life raft, the rigid compartment displacing sufficient water so that the personal life raft is buoyant while in use by the user.

2. The personal life raft of claim 1 further comprising a third port on a lower section of the rigid compartment and a flexible lower member in sealed connection with the third port, the flexible lower member being impervious to water.

3. The personal life raft of claim 2 wherein the flexible lower member comprises a lower torso portion in sealed connection with the third port and two flexible leg members extending from the lower torso portion.

4. The personal life raft of claim 3 wherein each of the first flexible arm member, the second flexible arm member and the flexible lower member are adapted to be drawn inside the body chamber of the rigid compartment via the first port, the second port and the third port, respectively.

5. The personal life raft of claim 4 wherein the rigid compartment comprises a closed cell foamed polymeric material.

6. The personal life raft of claim 1 further comprising a water port on an upper section of the rigid compartment via which water may enter the body chamber, the personal life raft further comprising a controller via which water flow into the body chamber from the water port is controlled.

7. The personal life raft of claim 6 further comprising a raised rim extending upward from a surface of the upper section of the rigid compartment which encompasses the water port, the raised rim having at least one passage there through, the at least one passage extending through the raised rim at a position above the surface of the upper section of the rigid compartment.

8. The personal life raft of claim 7 wherein the raised rim comprises a plurality of spaced passages extending through the raised rim, each of the plurality of spaced passages being at a position above the surface of the upper section of the rigid compartment.

9. The personal life raft of claim 1 further comprising an air port on an upper section of the rigid compartment via which air may enter the body chamber.

10. The personal life raft of claim 9 wherein the air port is covered with a cover member in sealed engagement with the upper section of the rigid compartment through which air may pass but through which water passage is limited.

11. The personal life raft of claim 10 wherein the cover member comprises a super-hydrophobic textile material.

12. The personal life raft of claim 10 further comprising a water collector positioned within the body chamber below a cap member.

13. The personal life raft of claim 1 further comprising a light port through which an emergency light may be extended and a light housing adapted to contain the emergency light which is extendible and retractable through the light port.

14. The personal life raft of claim 1 wherein the rigid compartment further comprises at least one translucent window.

15. The personal life raft of claim 1 further comprising at least one drag member in operative connection with the rigid compartment to create drag in air.

16. The personal life raft of claim 15 wherein the at least one drag member comprises a flexible wing, sail or a parachute.

17. The personal life raft of claim 3 wherein the flexible lower member comprises shoulder straps in operative connection with the lower torso portion.

18. The personal life raft of claim 8 further comprising an air port on an upper section of the rigid compartment via which air may enter the body chamber, the air port being positioned within the raised rim.

19. The personal life raft of claim 18 further comprising a light port through which an emergency light may be extended, the light port being positioned within the raised rim.

20. The personal life raft of claim 1 wherein at least the rigid compartment is formed from multiple detachable sections.

21. A method of providing life raft protection for a person on or near water comprising providing a personal life raft, comprising a rigid compartment, a first flexible arm member in sealed engagement with a first port on a first side of the rigid compartment, a second flexible arm member in sealed engagement with a second port on a second side of the rigid compartment, each of the first flexible arm member and the second flexible arm member being impervious to water, the rigid compartment having a body chamber therein having a volume to encompass at least an upper torso of the person, the rigid compartment displacing sufficient water so that the personal life raft is buoyant while in use by the person.

* * * * *